US006406270B1

(12) United States Patent
Kopel

(10) Patent No.: US 6,406,270 B1
(45) Date of Patent: Jun. 18, 2002

(54) FUEL TANK AND BELT GUARD ARRANGEMENT FOR COMPRESSOR

(75) Inventor: Andy Kopel, Lafayette, MN (US)

(73) Assignee: Coleman Powermate, Inc., Springfield, MN (US)

( * ) Notice: Subject to any disclaimer, the term of this patent is extended or adjusted under 35 U.S.C. 154(b) by 0 days.

(21) Appl. No.: 09/628,521

(22) Filed: Jul. 31, 2000

(51) Int. Cl.[7] ..... F04B 41/04; F04B 53/00

(52) U.S. Cl. ..... 417/237; 417/234; 417/364; 417/362

(58) Field of Search ..... 417/237, 234, 417/364, 362

(56) References Cited

U.S. PATENT DOCUMENTS

| | | | | |
|---|---|---|---|---|
| 4,077,747 A | * | 3/1978 | Burenga | 417/234 |
| 4,391,568 A | * | 7/1983 | Tenney | 417/237 |
| D276,997 S | | 1/1985 | Mikado | D13/3 |
| 4,536,132 A | * | 8/1985 | Tenney | 417/237 |
| 5,372,392 A | | 12/1994 | Dunn et al. | 285/334 |
| 5,831,366 A | | 11/1998 | Kern et al. | 310/216 |
| D449,311 S | * | 10/2001 | Graber et al. | D15/9 |

FOREIGN PATENT DOCUMENTS

| | | |
|---|---|---|
| JP | 8-270565 | * 10/1996 |

* cited by examiner

*Primary Examiner*—Charles G. Freay
*Assistant Examiner*—Michael K. Gray
(74) *Attorney, Agent, or Firm*—Kramer, Levin, Naftalis & Frankel LLP

(57) ABSTRACT

An air compressor includes a fuel tank at least partially supported by the air compressor guard, allowing for a larger fuel tank and eliminating the need for a separate fuel tank support. The air compressor includes a gasoline engine connected to an air pump via a belt; the guard covers the belt. A frame may also partially support the fuel tank. The air compressor may also include a manifold assembly, where the manifolds are connected via a unique mechanism. Two manifolds, each having a plate extending therefrom, surround a regulator, and the manifold plates are connected using a set of bolts. The regulator is held to the manifolds by being clamped between the plates.

5 Claims, 5 Drawing Sheets

FUEL TANK AND BELT GUARD ARRANGEMENT FOR COMPRESSOR

FIELD OF THE INVENTION

The present invention relates to air compressors, and more specifically, the present invention relates to an air compressor with an improved manifold assembly and an improved fuel tank support.

BACKGROUND INFORMATION

Air compressors provide an output of compressed air. A typical air compressor includes a motor or engine, such as a gasoline powered engine, providing power to an air pump via a power transfer device such as a belt. The air pump outputs compressed air to one or more pressurized air tanks acting as reservoirs for the pressurized air. In one current design, two pressurized air tanks are used as reservoirs. Air flows from these reservoirs to a manifold assembly, which provides air at a one or more outlets to a user.

One configuration of an air compressor includes two cylindrical air tanks located on the bottom of the compressor, extending its entire length. A handle is attached to each air tank at one end of the compressor and one or more wheels are located at the other end, giving the compressor a wheelbarrow-like configuration. The engine and air pump are located on top of or between these air tanks. The drive belt provides engine power to the air pump and extends along one side of the compressor. A guard covers the drive belt and pulleys. A frame helps to support the components. A fuel tank sits on top of the compressor to supply fuel to the engine.

In such a compressor the fuel tank may be supported completely by the engine itself. Such a method of supporting the fuel tank limits the size of the fuel tank. The fuel tank may also be supported by one or more separate structures which exclusively support the fuel tank and serve no secondary purpose, adding cost and weight to the compressor.

Such compressors may include a manifold assembly, which provides air at one or more outlets to a user. In one manifold design the manifold assembly includes two manifolds connected to a regulator. A first manifold accepts pressurized air from an air tank and outputs the air to the regulator, which outputs a pressure regulated stream of air to the second manifold. Each manifold provides one or more compressed air outputs for a user. The first manifold may provide an unregulated output and the second manifold may provide a regulated output. The regulator may allow a user to regulate and control the output pressure.

The regulator must be attached to the manifolds; typically the regulator is located between the two manifolds. One type of current design uses a piece having a regulator integrated into a manifold. This results in increased tooling costs and design effort and requires a custom designed regulator. Other current designs may attach the regulator to each manifold using, for example, a pipe thread method, or an angled pipe thread method. In either method tolerances in the assembly may be difficult to control.

It would be desirable to have a manifold assembly in a compressor where the connection between the manifolds and the regulator conforms to relatively tight tolerances. It would be desirable to have a compressor design where components, such as the fuel tank, are supported in a manner allowing for a larger fuel tank, and in a more efficient manner, allowing for a lighter and less expensive compressor.

SUMMARY OF THE INVENTION

The air compressor of an exemplary embodiment of the present invention includes a gasoline engine connected to an air pump via a power transfer device such as a belt; a guard covers the belt. The fuel tank is at least partially supported by the guard, allowing for a larger fuel tank and eliminating the need for a separate tank support. A frame may also partially support the fuel tank. An embodiment of the air compressor also includes a manifold assembly where the manifolds are connected via a unique mechanism. Two manifolds, each having a plate extending therefrom, surround a regulator, and the manifold plates are connected using a set of bolts. The regulator is held to the manifolds by being clamped between the plates.

DETAILED DESCRIPTION OF THE INVENTION

In the following description, various aspects of the present invention will be described. For purposes of explanation, specific configurations and details are set forth in order to provide a. thorough understanding of the present invention. However, the present invention may be practiced using alternate configurations and arrangements. Furthermore, some well known features may be omitted or simplified in order not to obscure the present invention.

Figure 1:
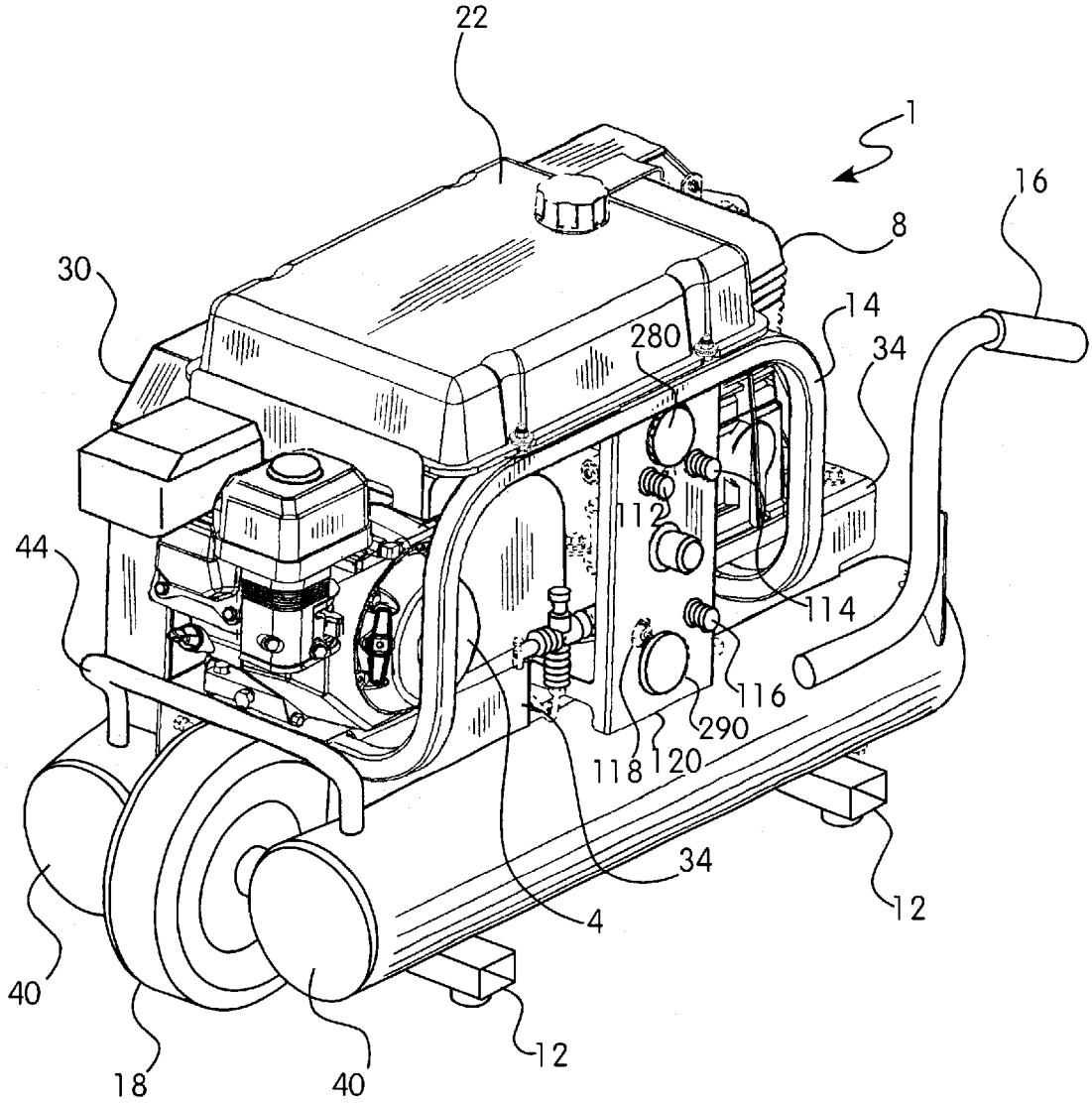
FIG. 1 illustrates an air compressor according to an exemplary embodiment of the present invention.
Figure 2:
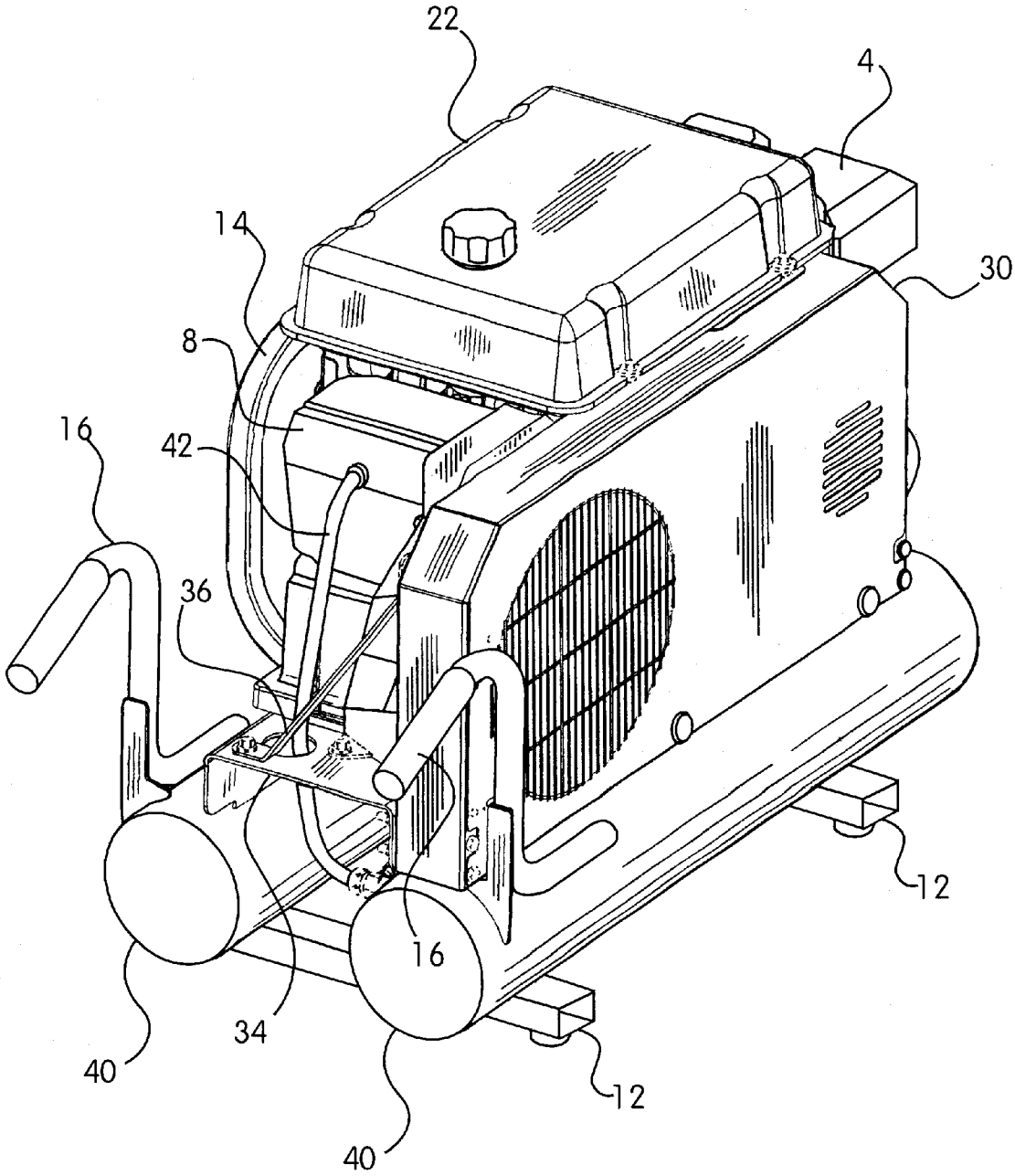
FIG. 2 illustrates an air compressor according to an exemplary embodiment of the present invention.

FIGS. 1 and 2 illustrate an air compressor according to an exemplary embodiment of the present invention. The air compressor 1 includes an engine 4, connected by a belt 6 (depicted in phantom) to an air pump 8. The engine 4 turns the belt 6 to operate the air pump 8. The engine 4 is preferably a gasoline engine of known construction, and alternately may be another sort. of engine or motor. The air pump 8 is of known construction, and uses two pistons to produce compressed air. In alternate embodiments, the air pump may be of another construction and may have another, number of pistons.

The belt may be of known construction, and may be any sort of strip or flexible mechanism for transferring power between a motor and an air pump. For example, the belt may be a rope or a chain. The belt may also be any power transfer device such as gears or a shaft.

In an exemplary embodiment, two air tanks 40 of known construction are located underneath the engine 4 and the air pump 8, and are connected by horizontal struts 12, and by a platform 34. The air tanks 40 store high pressure air compressed by the air pump 8. In alternate embodiments, other numbers or arrangements of air tanks may be used. A frame 14 supports a control panel 20 and a fuel tank 22, supplying gasoline to the engine 4. A guard 30 covers the belt 6, and a pulley (not shown) and a flywheel (not shown), and supports the fuel tank 22. A platform 34 extends between the two air tanks 40 to connect the air tanks 40, and to support the guard 30, the control panel 20, the engine 4, the frame 14 and the air pump 8. The guard 30 is also supported by a strut 36 extending from the platform 34. Two handles 16 extend from the air tanks, one handle 16 extending from each of the air tanks 40, and a wheel 18 is supported between the other end of each of the air tanks as 40 by an axle (not shown).

When used herein, a first structure which "supports" a second structure may exclusively or partially support that second structure. Thus, that the guard 30 supports the fuel tank 22 may indicate that the guard 30 is the only structure supporting the fuel tank 22 or that the guard 30 supports the fuel tank 22 in cooperation with another structure.

The guard may be any guard appropriate for the power transfer system used, such as a belt guard, a gear train guard, or a guard for a rotating shaft.

The frame 14 is preferably an approximately one inch by one inch metal tube, but may be built from other materials. In alternate embodiments, the frame 14 or the platforms 34 may be of another structure, or may not be required. In alternate embodiments, the frame 14 and the platform 34 may support different combinations of components in different manners. The guard 30 may be any sort of mechanism or structure for shrouding a belt, chain or other structure.

Figure 3:
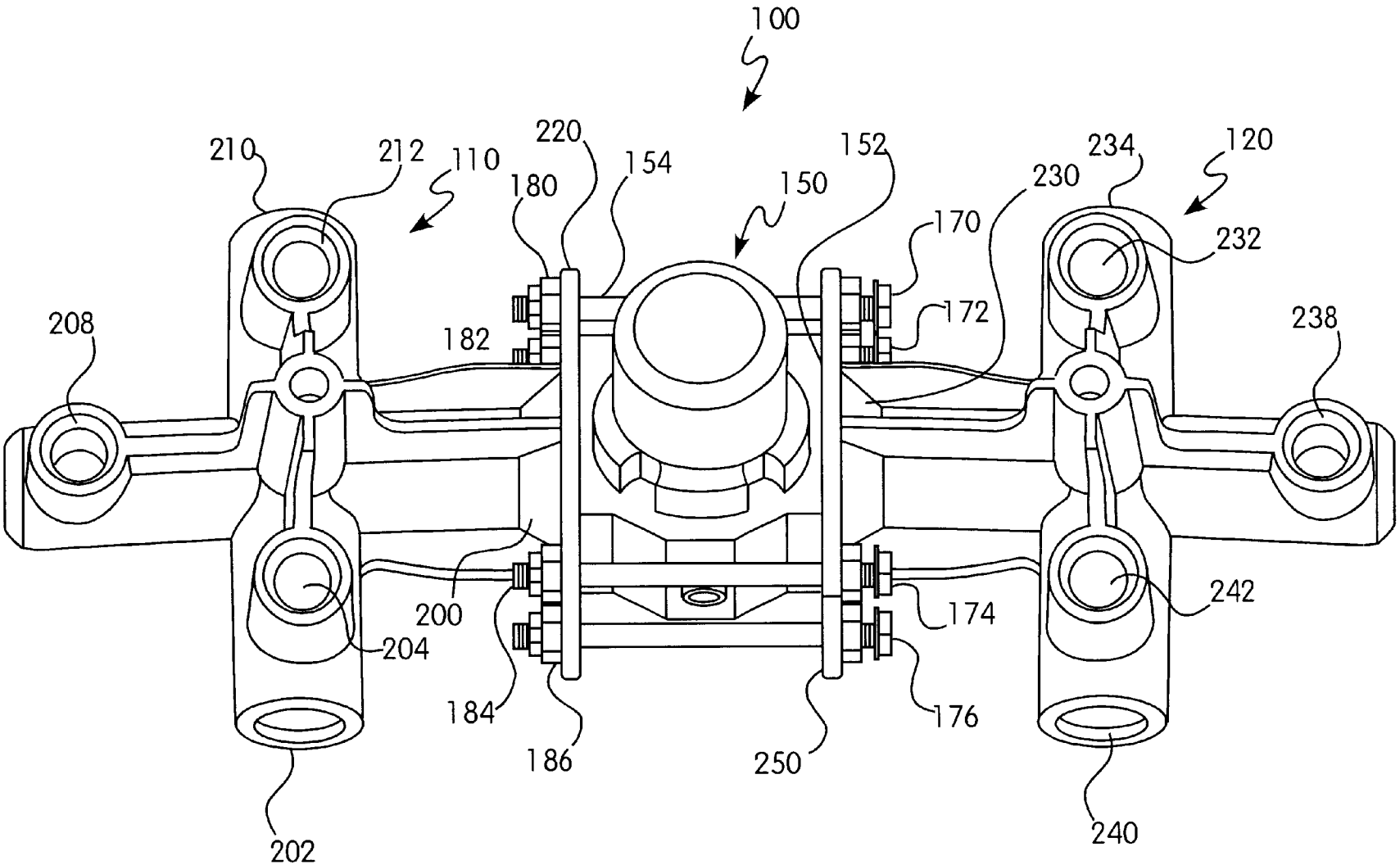
FIG. 3 illustrates a portion of the manifold assembly of an air compressor according to an exemplary embodiment of the present invention.

Preferably, the control panel 20 includes gauges 280 and 290 displaying aspects of the operation of the compressor 1. One of the air tanks 40 outputs compressed air to a manifold assembly 100, located behind the control panel 20. FIG. 3 illustrates a portion of the manifold assembly 100. The manifold assembly 100 is partially hidden in FIG. 1. The manifold assembly 100 includes two manifolds 110 and 120, regulator 150, quick couplers 112, 114 and 116, a relief valve 118, and pressure gauges 280 and 290. A user may attach hoses to the quick couplers 112–116 to receive a supply of compressed air. The pressure gauge 280 indicates pressure at the upper set of quick couplers 112 and 114 and the pressure gauge 290 indicates pressure at the lower quick coupler 116. In alternate embodiments, the manifold assembly 100 may be located in a different section of the compressor; the manifold assembly 100 may be of a different configuration.

During operation, the engine 4 turns the belt 6 which, in turn operates the air pump 8, which compresses air. The compressed air is sent to one of the air tanks 40 via a transfer tube 42. Air may flow between the air tanks 40 via a crossover tube 44. Air flows from one of the air tanks 40 to the manifold assembly 100, which provides compressed air which a user may access.

In an exemplary embodiment, the fuel tank 22 is supported partially by the guard 30 and partially by the frame 14. This arrangement allows for a larger fuel tank 22. In an exemplary embodiment, the fuel tank 22 holds three gallons of gasoline, but alternately may hold other amounts or types of fuel. This also allows for a lighter and less expensive design, as less components and lighter materials than conventional designs can be used to support the fuel tank 22. The guard 30 thus performs the multiple functions of shielding the belt 6 and supporting or partially supporting the fuel tank 22. The guard 30 may be of heavier construction than conventional guards. In an exemplary embodiment, the guard 30 is constructed of metal such as sheet metal steel, but in other embodiments may be constructed of other materials, such as plastic. In an exemplary embodiment, one side of the fuel tank 22 is supported by the frame 14. Alternately, the fuel tank 22 may be partially supported by a structure other than the frame 14, or the fuel tank 22 may be completely supported by the guard 30.

The compressor of an exemplary embodiment of the present invention includes a manifold assembly having a novel structure, allowing for tighter tolerances between the manifolds and the regulator. FIG. 3 illustrates a portion of the manifold assembly of an air compressor according to an exemplary embodiment of the present invention. Referring to FIG. 3, the manifold assembly 100 includes two manifolds 110 and 120 and regulator 150. Not shown in FIG. 3 are the quick couplers,112, 114 and 116, the relief valve 118, and the pressure gauges 280 and 290, shown in FIG. 1, which are attached to the manifold assembly 100. Other components may bemused as air supplies or outlets, controllers, etc. Moreover, the various components may be arranged in a variety of configurations.

Figure 4:
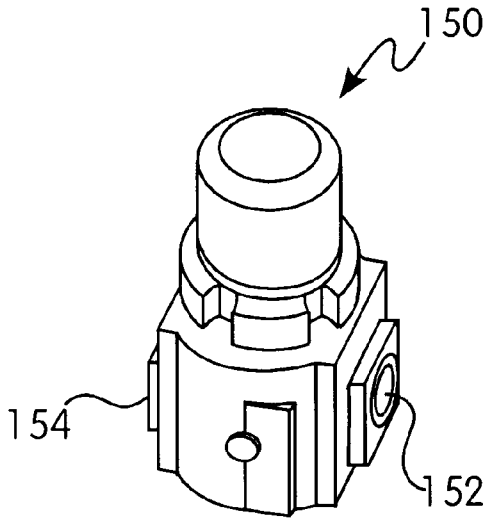
FIG. 4 illustrates the regulator of an air compressor according to an exemplary embodiment of the present invention.
Figure 5:
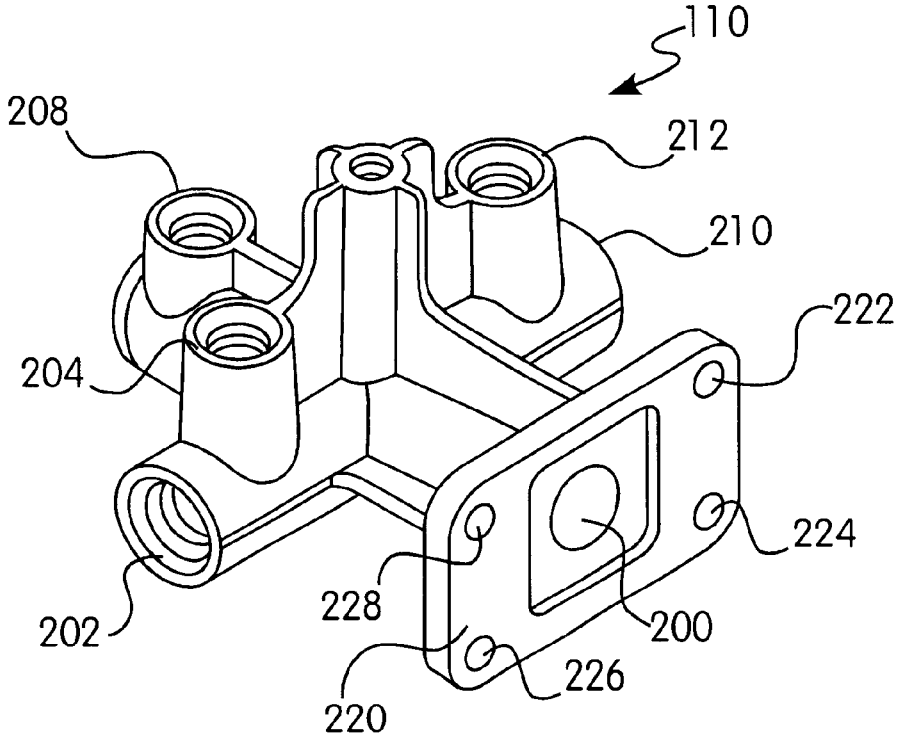
FIG. 5 illustrates a manifold of an air compressor according to an exemplary embodiment of the present invention.
Figure 6:
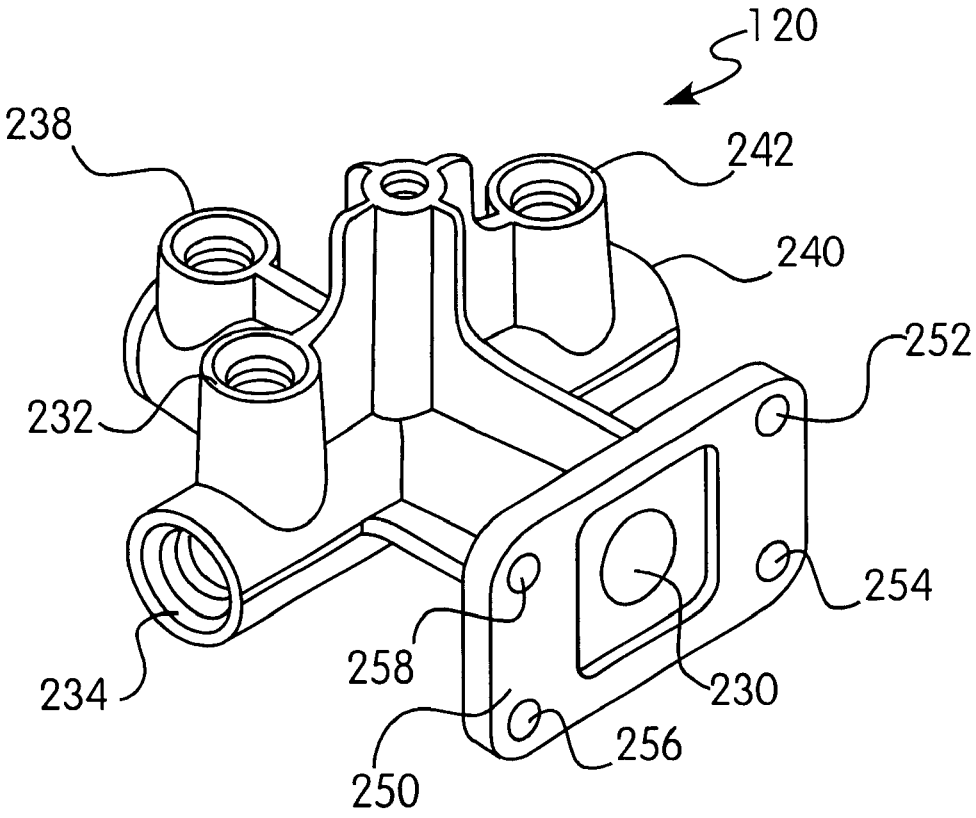
FIG. 6 illustrates a manifold of an air compressor according to an exemplary embodiment of the present invention.

FIG. 4 illustrates the regulator of an air compressor according to an exemplary embodiment of the present invention. FIG. 5 illustrates a manifold of an air compressor according to an exemplary embodiment of the present invention. Referring to FIG. 5, the manifold 110 includes six inlets and outlets 200, 202, 204, 208, 210 and 212. FIG. 6 illustrates a manifold of an air compressor according to an exemplary embodiment of the present invention. Referring to FIG. 6, the manifold 120, includes six inlets and outlets 230, 232, 234, 238, 240 and 242. Each manifold 110 and 120 includes a plate having screw holes enabling clamping to the other manifold and thus to the regulator 150. The manifold 110 includes a plate 220 with screw holes 222, 224, 226 and 228, and the manifold 120 includes a plate 250 with screw holes 252, 254, 256 and 258. Referring to FIG. 4, the regulator 150 includes an inlet 152 and an outlet 154. In an alternate embodiment, screws may attach to structures on manifolds other than plates; for example a set of extensions.

Each manifold 110 and 120 is of a standard construction, and accepts an airflow, splits the airflow into separate paths, and provides the airflow to various components. Each manifold 110 and 120 is preferably constructed of zinc #5, but may be constructed of other materials. In alternate embodiments, manifolds having other combinations or arrangements of inlets and outlets may be used. For example, two non-identical manifolds may be used.

When assembled into the manifold assembly 100, the manifold outlet 230 connects to the regulator inlet 152, and the manifold inlet 200 connects to the regulator outlet 154. Referring to FIGS. 1 and 3, The manifold outlet 208 is connected to the pressure gauge 280, and the manifold outlet 238 is connected to the pressure gauge 290. The outlet 204 is connected to the quick coupler 112, the outlet 212 is connected to the quick coupler 114, the outlet 232 is connected to the quick coupler 116, and the outlet 242 is connected to the relief valve 118. The quick couplers preferably comprise brass fittings which screw into the manifold outlets and which provide an output to which a user may connect a hose. The outlets 202 and 210 are stopped by plugs, not shown. The outlet 234 is connected to one of the air tanks 40 via a tube. The outlet 240 is connected to a pilot valve of known construction which signals the engine 4 to idle when a certain upper pressure is reached, and signals. the engine 4 to speed up when another, lower pressure is reached. Alternately, other configurations are possible, and other air flow patterns are possible.

In operation, the manifold 120 accepts a pressurized airflow from one of the air tanks 40 via outlet 234 and provides an air flow to the inlet 152 on the regulator 150, to the pressure gauge 290, to the relief valve 118, and to the quick connector 116. The regulator 150, which can be of a standard construction, accepts an air flow at the regulator inlet 152, regulates the pressure of the flow, and produces an airflow of a constant pressure at the regulator outlet 154, connecting to the manifold 110. The manifold 110 accepts the regulated airflow from the regulator 150 at inlet 200 and provides this air flow to the quick couplers 112 and 114 and to the pressure gauge 280. In alternate embodiments, a regulator and manifolds may be used with different constructions, and with different numbers and configurations of inlets and outlets. For example, a regulator used with the manifold assembly of an embodiment of the present invention may be any device restricting, limiting or controlling the flow of gas.

In an exemplary embodiment, the manifolds 110 and 120 are joined to the regulator 150 in a novel manner. The manifolds 110 and 120 are clamped to each other using a set of bolts, sandwiching the regulator 150 and thus clamping the manifolds 110 and 120 to the regulator 150. In such a manner the manifolds 110 and 120 may be clamped to the regulator 150 with a high degree of accuracy, reducing the tolerance problems seen in current designs. This may also-result in less tooling costs and design efforts and allows the use of an "off the shelf" existing regulator. A set of four bolts 170, 172, 174 and 176 extend between plate 220 and plate 250. Each bolt is secured to the plate 220 via a nut. Bolt 170.is secured by nut 180, bolt 172 is secured by nut 182, bolt 174 is secured by nut 184, and bolt 176 is secured by nut 186. The regulator 150 is held to the manifolds 110 and 120 by being clamped between the plate 220 and the plate 250. A seal, for example an O-ring or flange (not shown), may be positioned between the regulator 150 and the manifolds 110 and 120. In alternate embodiments, other types of fasteners or structures may be used to join the manifolds; for example pins or wires. Further, the manifold assembly itself may be configured in a different manner, with different numbers and arrangements of components.

In alternate embodiments, the manifold assembly of the present invention may be used with air compressors of other configurations, or may be used in a device other than an air compressor.

While the compressor of the present invention is described with respect to specific embodiments, it should be noted that the present invention may be implemented in different manners and used with different applications.

What is claimed is:

1. An air compressor comprising:

an engine;

an air pump;

power transfer device connecting the engine and the air pump;

a guard covering the power transfer device; and a fuel tank supplying gas to the engine, wherein the fuel tank is supported by the guard.

2. The air compressor of claim 1 comprising a frame, wherein the fuel tank is supported by the guard and the frame.

3. The air compressor of claim 1 wherein the power transfer device comprises a belt and the guard comprises a belt guard.

4. The air compressor of claim 2 wherein the frame comprises a metal tube.

5. The air compressor of claim 1, wherein the guard comprises sheet metal.

* * * * *